US007232977B2

(12) United States Patent
Yamano

(10) Patent No.: US 7,232,977 B2
(45) Date of Patent: Jun. 19, 2007

(54) FUSING DEVICE

(75) Inventor: Miho Yamano, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 5 days.

(21) Appl. No.: 11/181,099

(22) Filed: Jul. 14, 2005

(65) Prior Publication Data

US 2006/0076345 A1 Apr. 13, 2006

(30) Foreign Application Priority Data

Oct. 8, 2004 (JP) ..... 2004-296004

(51) Int. Cl.
*H05B 6/14* (2006.01)

(52) U.S. Cl. ..... 219/619; 399/328; 399/330

(58) Field of Classification Search ..... 219/619, 219/216, 469; 399/328–330, 333–334
See application file for complete search history.

(56) References Cited

U.S. PATENT DOCUMENTS

2002/0006296 A1* 1/2002 Omoto et al. ..... 399/330
2004/0136761 A1* 7/2004 Asakura et al. ..... 399/328

FOREIGN PATENT DOCUMENTS

JP 2003-215954 7/2003

* cited by examiner

*Primary Examiner*—Quang Van
(74) *Attorney, Agent, or Firm*—Cantor Colburn LLP

(57) ABSTRACT

Disclosed herein is an induction heating type fusing device for fixing toner image on a transfer material. The fusing device includes an exciting coil that induces induction magnetic field by applying AC current; a hollow heating member installed near the exciting coil; multiple magnetic members mounted inside the heating member in the longitudinal direction; and a drive section that moves the multiple magnetic members in accordance with the width of transfer material to be fixed.

11 Claims, 7 Drawing Sheets

FUSING DEVICE

CROSS-REFERENCE TO RELATED APPLICATION

This application is based on Japanese Patent Application No. 2004-296004 filed with Japan Patent Office on Oct. 8, 2004.

BACKGROUND OF THE INVENTION

1. Field of the Invention

The present invention relates to a fusing device used for an image forming apparatus such as copy machine, printer, facsimile, and composite machine thereof. The invention also relates to a fusing device that can heat transfer material in accordance with its paper width.

2. Description of the Related Art

On an electro-photographic image forming apparatus such as copy machine, printer, facsimile, and composite machine thereof, latent image corresponding to an original is formed on a photosensitive material, toner is applied to the latent image to transform it into a visible image, the visible toner image is transferred on a recording paper (transfer material), and then the toner image transferred on the recording paper is fixed.

A fusing device for fixing toner image in a manner like the above includes a heating roller type fusing device in which recording paper having transferred toner image is heated and pressed while it is held and conveyed between a heating roller containing halogen heater or the like and a pressing roller for pressing the heating roller. This type of fusing device is widely utilized because of its simple construction and also because of excellent fixability onto transfer material. Both heating roller and pressing roller are made of core metal coated with rubber layer.

A fusing device like the above involves a problem of longer warming-up time (WUT) since heat cannot be transmitted easily because of thick rubber layer and accordingly heating time of the heating roller becomes longer.

To solve the above problem, an electro-magnetic heating type belt fusing device is utilized. This belt fusing device is constructed as follows: an endless fixing belt is passed between a heating roller and a fixing roller; there is provided a pressing roller that presses the fixing roller via the fixing belt; by applying high-frequency AC current to an exiting coil installed near the heating roller, induction flux is so induced that the heating roller generates heat and consequently the fixing belt is heated; and toner image on a transfer material is fixed while the transfer material is held and conveyed in a nip formed between the fixing belt and the pressing roller.

Since the heating efficiency of electro-magnetic heating type is high and the heat capacity of fixing belt is small, warming-up time decreases. In addition, power consumption (energy consumption) decreases.

However, because the heat capacity of fixing belt is small, temperature drop due to radiation is remarkable and the heat conductivity is low. Accordingly, if a recording paper narrower than the width of the fixing belt is fed, temperature increases at both edges of the fixing belt where no paper passes through because heat is not taken by the recording paper. This temperature increase is accelerated in case of continuous paper feeding.

For example, if a narrow recording paper such as A4R size is continuously fed, temperature of the edges where no recording paper passes through increases. Then, when a recording paper of A4 size is fed, uneven gloss is caused on the toner image formed at the edges, wrinkle is caused on the paper, or toner at the edges offsets onto the fixing belt, which results in a problem that favorable fixed image cannot be obtained. In some cases, the fixing belt may deform due to temperature difference.

A known technique for solving the problem by cooling the edges of the fixing belt is to supply air from a cooling fan.

Since the above problem is caused also on an electro-magnetic heating type fusing device that does not employ fixing belt, there have been disclosed preventive measures such as the fusing device as set forth in the Japanese Application Patent Laid-open Publication No. 2003-215954, where a center coil is provided at the center inside the heating roller and additional edge coil is also provided at each edge inside and energizing time of the three coils is controlled in accordance with the width of recording paper to be fixed.

The method where the edges of the fixing belt are cooled by air from a cooling fan is not favorable because power is needed for cooling. Besides, a method employing cooling as well as heating is not acceptable at all in the present days where energy conservation is strongly needed.

In the fusing device as set forth in the Japanese Application Patent Laid-open Publication No. 2003-215954, control of the energizing time of the three coils is very much complicated but still heating evenly in the axial direction is difficult. Besides, use of three coils increases cost.

SUMMARY

The present invention has been made in view of the above problems and an object of the invention is to offer an electro-magnetic heating type fusing device in which heating area can be varied by using only one exciting coil. Another object of the invention is to offer an electro-magnetic heating type belt fusing device in which heating area on the fixing belt can be varied in the axial direction. Another object of the invention is to offer an image forming apparatus equipped with a fusing device like the above.

In order to achieve at least one of the above objects, a fusing device according to an embodiment of the present invention comprises: an exciting coil that induces induction magnetic field by applying AC current; a hollow heating member installed near the exciting coil; multiple magnetic members mounted inside the heating member in the longitudinal direction; and a drive that moves the multiple magnetic members in accordance with the width of transfer material to be fixed.

In the above fusing device, preferably, the heating member is a rotating roller.

In addition, in the above fusing device, given that the relative magnetic permeability of the heating member is $\mu 1$ and thickness is $t1$ and that the relative magnetic permeability of the magnetic member is $\mu 2$ and thickness is $t2$, preferably, $\mu 1<\mu 2$ and $t1<t2$ are met.

In addition, in the above fusing device, preferably, the outside of the magnetic member is shaped into an approximate cone with its apex in the moving direction and also a concave of the approximately same shape is provided on the bottom of the cone.

In addition, preferably, the above fusing device is further equipped with a fixing roller; and a fixing belt that is passed between the heating member and the fixing roller and heated by heat from the heating member.

Preferably, the above fusing device is further equipped with a pressing roller that presses the fixing roller via the fixing belt.

In addition, preferably, the above fusing device is equipped with elastic member provided between each of the multiple magnetic members; and a mechanism for compressing the elastic member.

BRIEF DESCRIPTION OF DRAWINGS

These and other objects, advantages and features of the invention will become apparent from the following description thereof taken in conjunction with the accompanying drawings in which.

DETAILED DESCRIPTION OF THE PREFERRED EMBODIMENTS

Hereinbelow, typical embodiments of the present invention will be explained with reference to the drawings. It should be note that the present invention is not limited to the embodiments described below. Definitions of terms described below are given by way of explanation of the terms only, and thus the definitions of the terms of the inventions are not limited thereto.

These and other objects, advantages and features of the invention will become apparent from the following description thereof taken in conjunction with the accompanying drawings in which:

An embodiment of the image forming apparatus of the present invention is described hereunder.

Figure 1:
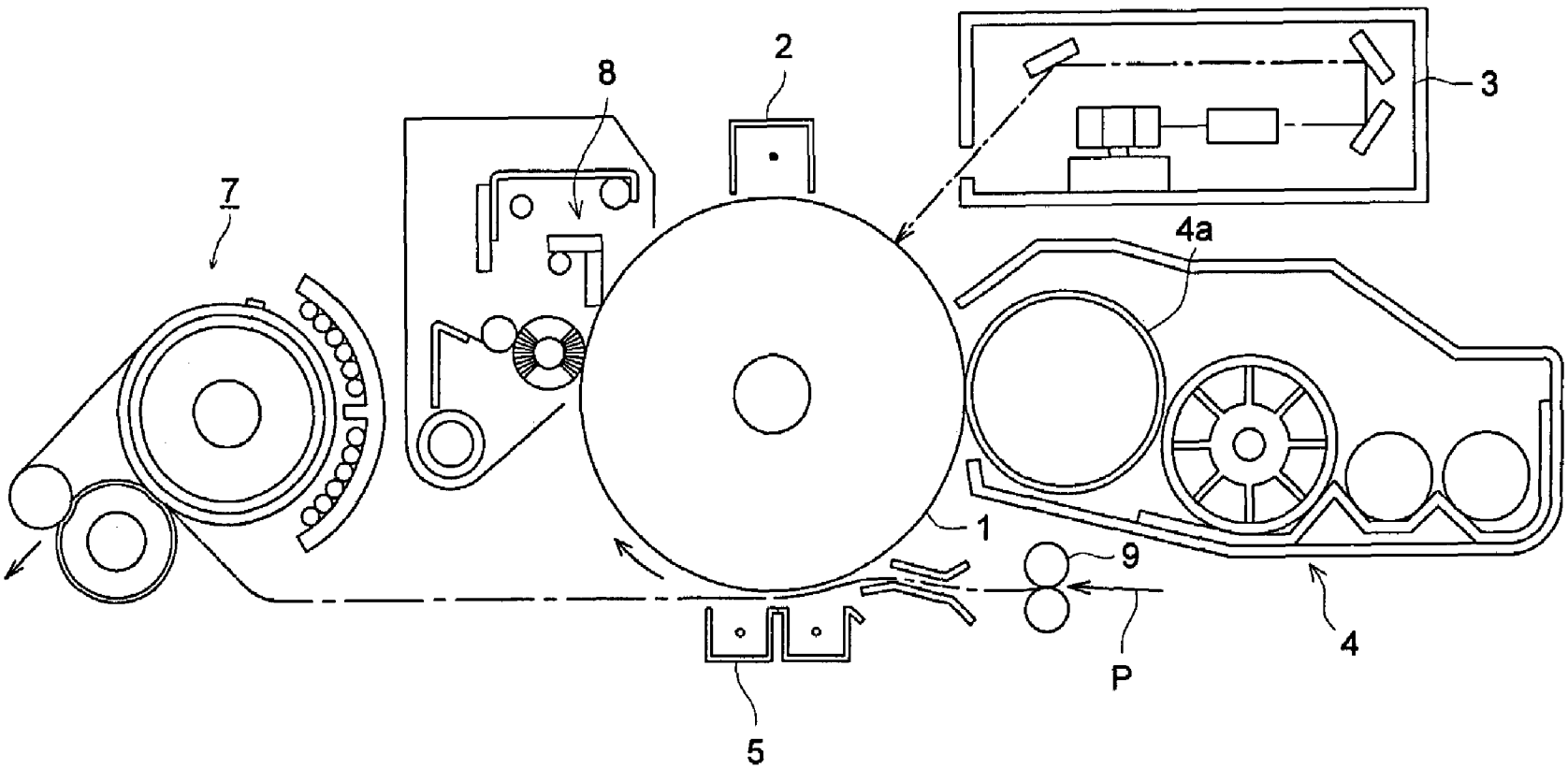
FIG. 1 is a cross-sectional view showing the basic construction of the image forming apparatus.

To begin with, the image forming apparatus using the induction heating type fusing device of the present invention is described hereunder, making reference to the basic construction in FIG. 1.

In FIG. 1, 1 is a photosensitive drum made of electrophotographic sensitive material. The photosensitive drum 1 is rotated in the arrow direction at a specified circumferential speed and the surface is evenly charged at specified negative potential VH by an electric charger 2.

3 is a exposing device that outputs modulated laser beam in accordance with time-series digital pixel signal of the image data inputted from image reader or computer (not shown). The evenly charged surface of the photosensitive drum 1 is scanned and exposed by the laser beam. Consequently, the absolute potential at the exposed part of the photosensitive drum 1 decreases to potential VL and static latent image is formed on the surface of the photosensitive drum 1.

A developer 4 is equipped with a developing roller 4*a* that is driven to rotate. The developing roller 4*a* is installed opposite to the photosensitive drum 1 and a thin toner layer charged negative is formed on the outside surface. A developing bias voltage, of which absolute value is lower than the potential VH and higher than the potential VL of the photosensitive drum 1, has been applied to the developing roller 4*a*, and because of this, toner on the developing roller 4*a* sticks onto a portion at the potential VL on the photosensitive drum 1 and consequently toner image is formed.

On the other hand, recording paper P, which is a transfer material fed from a paper feeder (not shown), is passed through a resist roller 9 and then sent to the transfer area formed by the photosensitive drum 1 and a charged transfer pole 5 at a suitable timing in synchronism with the photosensitive drum 1. Then, the toner image on the photosensitive drum 1 is transferred onto the recording paper P by the charged transfer pole 5 to which transfer bias voltage has been applied.

The recording paper P with transferred toner image is then conveyed to the fusing device 7 and the toner image transferred on the recording paper P is fixed. After passing through the fusing device, the recording paper P with fixed toner image is then ejected on a paper tray (not shown).

On the other hand, after the recording paper P is separated, the photosensitive drum 1 is cleaned of residual particles including toner remaining on the surface after transfer by a cleaning device 8, and then the cleaned photosensitive drum 1 is put into service repeatedly for next image forming.

Although the image forming apparatus described above is for forming monochrome image, the fusing device of the present embodiment is applicable to an apparatus for forming color image.

Figure 2:
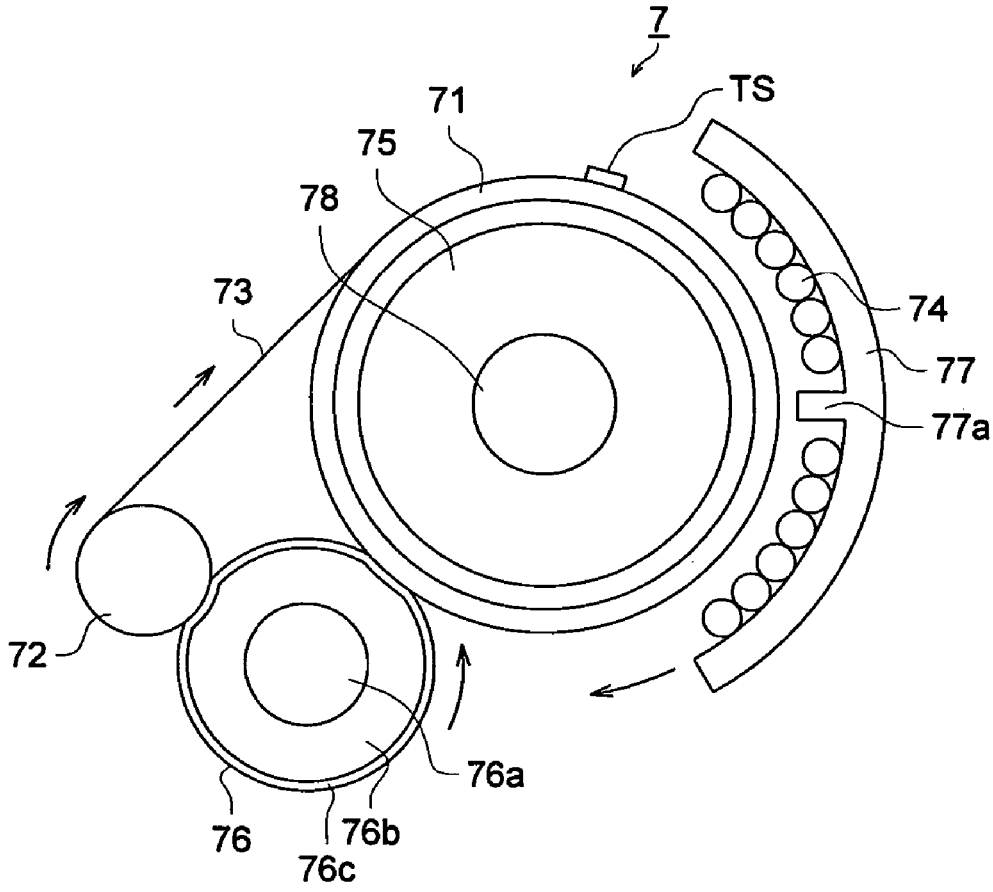
FIG. 2 is a cross-sectional view showing a brief construction of the induction heating type fusing device.

Next, the induction heating type fusing device 7 of the present embodiment is described hereunder. FIG. 2 is a brief cross-sectional view of the induction heating type fusing device 7.

The fusing device 7 comprises a fixing belt 73 passed between a heating roller 71 (heating member) and fixing roller 72, exciting coil 74 installed near the heating roller 71, core 75 (magnetic member) mounted inside the hollow heating roller 71, and pressing roller 76 that presses the heating roller 71 and fixing roller 72 via the fixing belt 73; with which construction the heating roller 71 is made to generate heat by the induction flux induced by applying high-frequency AC current to the exiting coil 74, the fixing belt 73 is heated by the heat, and the toner image on the recording paper P is heated and pressed for fixation while the recording paper P is held and conveyed between the fixing belt 73 and the pressing roller 76.

The heating roller 71 is made of thin magnetic metal in a cylindrical shape. For example, it uses nickel having the relative magnetic permeability $\mu 1$ of 180 to 200, thickness t1 is made to 0.5 mm so as to minimize the heat capacity, and then it is coated with PFA (perfluoro alkoxy) of 10 μm.

Instead of a heating roller 71, it is acceptable to provide a heating material of which cross-section perpendicular to the axial direction is a fixed semi-circular shape and around which surface the fixing belt 73 slides. In this construction, the diameter of the cylinder must be at least 55 mm for fixing at a linear speed of 320 mm/sec and the diameter of the cylinder shall preferably be larger in case of higher linear speed.

The fixing roller 72 is a roller of which surface is coated with foamed elastic silicone rubber having the rubber hardness of 40 Hs to 80 Hs (JIS, A rubber hardness).

The fixing belt 73 is an endless flexible belt, generally a metallic belt made of nickel having a thickness of about 20 to 80 μm or heat-resisting resin belt made of polyimide or polyamide having a thickness of about 40 to 150 μm, of which outside is coated with heat-resisting silicone rubber having a thickness of about 100 to 300 μm and further provided with PFA coating or tubing having a thickness of about 30 to 50 μm as a releasing layer.

The exciting coil 74 is made of litz wire, a bundle of thin wires, and supported by an arc-shaped coil support 77. The exciting coil 74 is laid one after another starting from the center 77*a* of the coil support 77 and evenly spaced from the heating roller 71.

The core 75, consisting of multiple cores, is donut-shaped and supported by a shaft 78 inside the heating roller 71. For example, it uses iron having the relative magnetic permeability μ2 of 1800 to 2000 and thickness t2 of 0.8 mm.

Accordingly, μ1<μ2 and t1<t2 are met.

The heating roller 76 is a soft roller comprising a core metal 76*a* made of stainless steel bar, roller layer 76*b* made of heat-resisting fluorine-contained rubber or silicone rubber having the rubber hardness of 10 Hs to 40 Hs (JIS, A rubber hardness), and releasing layer 76*c* that is a PFA tube coated on the surface of the roller layer 76. The heating roller 76 is pressed onto the heating roller 71 and fixing roller 72 via the fixing belt 73 by a pressing portion (not shown) so as to form a nip.

TS is a temperature sensor sensing the temperature of the fixing belt 73.

In the fusing device 7 made to the above construction, high-frequency AC voltage of 20 kHz to 50 kHz is applied to the exciting coil 74 by an exciting circuit (not shown). Consequently, induction magnetic field is induced and focused on the core 75 by the current through the exciting coil 74, and then eddy current is generated at a portion of the heating roller 71 facing the core 75 and the heating roller 71 generates heat. The fixing belt 73 is heated by this heat and the heat is accumulated inside, and as it rotates, the heat is conveyed to the nip formed by the fixing belt 73 and pressing roller 76. When the recording paper P is conveyed into this nip and heated and pressed, the toner image on the recording paper P is fixed.

Next, the core 75 is described in detail hereunder, using FIG. 3 to FIG. 7.

Figure 3:
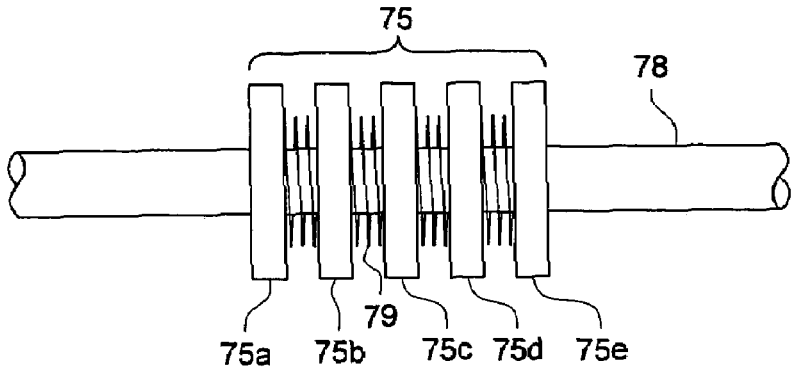
FIG. 3 shows the arrangement of multiple cores that move in accordance with the width of recording paper.
Figure 3:
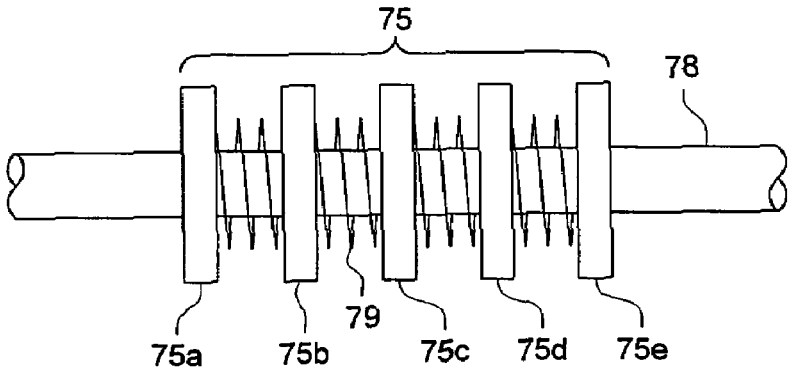
Figure 3:
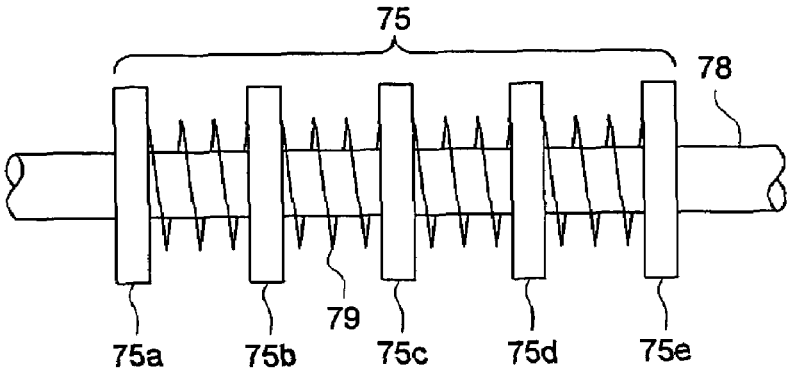

To begin with, description is made using FIG. 3. FIG. 3 shows the arrangement of multiple cores that move in accordance with the width of the recording paper P.

In FIG. 3, multiple cores 75*a* to 75*e* are supported on a shaft 78 and a compression spring 79 is inserted between each core. Only the center core 75*c* is fastened on the shaft 78, and the left-hand cores 75*a* and 75*b* and right-hand cores 75*d* and 75*e* slide respectively on the shaft 78 so that the heat distribution changes in accordance with the width of the recording paper P to be fixed. In other words, the distance between the core 75*a* and 75*e* is changed while keeping the distance between each adjacent core 75*a* to 75*e* equally and, as the induction magnetic field is focused on the cores 75*a* to 75*e*, the heating roller 71 is partially heated from around its center and consequently the fixing belt 73 is partially heated.

Although the number of cores 75 in FIG. 3 is 5, it is not limited to 5 but any will do.

For example, in case a recording paper P of a small size such as postcard is to be fixed, the core 75*a* is pressed from the left and the core 75*e* is pressed from the right as shown in FIG. 3(A) so that the cores 75*a* to 75*e* are positioned near the center portion corresponding to the width of the small-size recording paper P. Accordingly, induction magnetic field is induced in accordance with the width of the small-size recording paper P and thereby the heating area of the heating roller 71 corresponds to the small-size recording paper P.

Next, for example, in case a recording paper P of a medial size, such as A4 size fed longitudinally (A4R), is to be fixed, the core 75*a* is pressed from the left and the core 75*e* is pressed from the right in a smaller length than in case of small size as shown in FIG. 3(B) so that the cores 75*a* to 75*e* are positioned corresponding to the width of the medium-size recording paper P. Accordingly, induction magnetic field is induced in accordance with the width of the medium-size recording paper P and thereby the heating area of the heating roller 71 corresponds to the medium-size recording paper P.

Furthermore, for example, in case a recording paper P of a large size, such as A4 size fed laterally, is to be fixed, the core 75*a* is pressed from the left and the core 75*e* is pressed from the right in a far smaller length as shown in FIG. 3(C) so that the cores 75*a* to 75*e* are positioned corresponding to the width of the large-size recording paper P. Accordingly, induction magnetic field is induced in accordance with the width of the large-size recording paper P and thereby the heating area of the heating roller 71 corresponds to the large-size recording paper P.

Because the force applied by each compression spring 79 is equal, the distance between each adjacent core 75*a* to 75*e* becomes equal.

In FIG. 3(C), if each stopper for limiting the core 75*a* and core 75*e* is provided on the left of the core 75*a* and on the right of the core 75*e*, the position of each core 75*a* and core 75*e* is determined automatically in case of feeding a recording paper P of the maximum width and therefore pressing the core 75*a* and 75*e* is no longer necessary.

Figure 4:
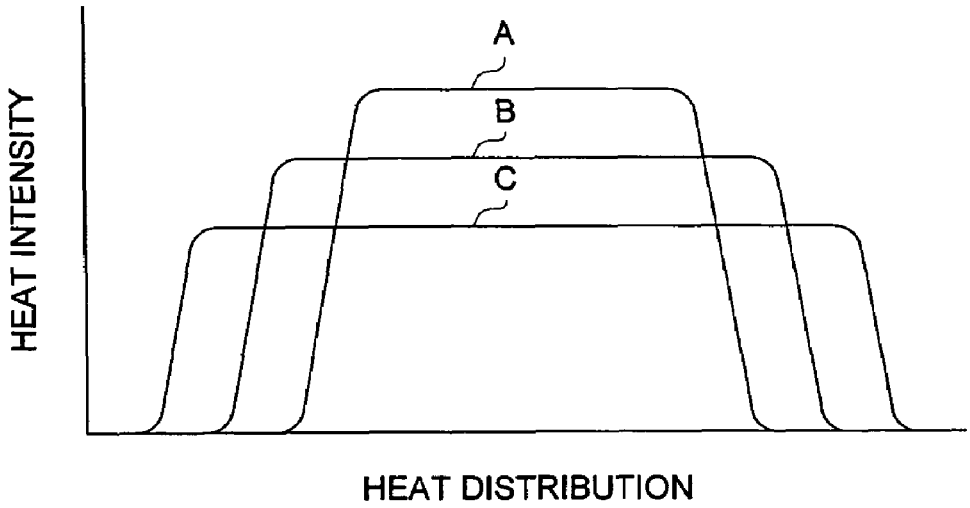
FIG. 4 is a chart showing the heat distribution vs. heat intensity of the heating roller.

In FIG. 4, where the vertical axis is the heat distribution on the heating roller 71 and the horizontal axis is the heat intensity of the heating roller 71, curve A represents the condition in FIG. 3(A), curve B represents the condition in FIG. 3(B), and curve C represents the condition in FIG. 3(C). Since the heat intensity become high as the heat distribution becomes narrower according to FIG. 4, the duration of applying high-frequency AC current to the exciting coil 74 is shortened in the latter cases.

Figure 5:
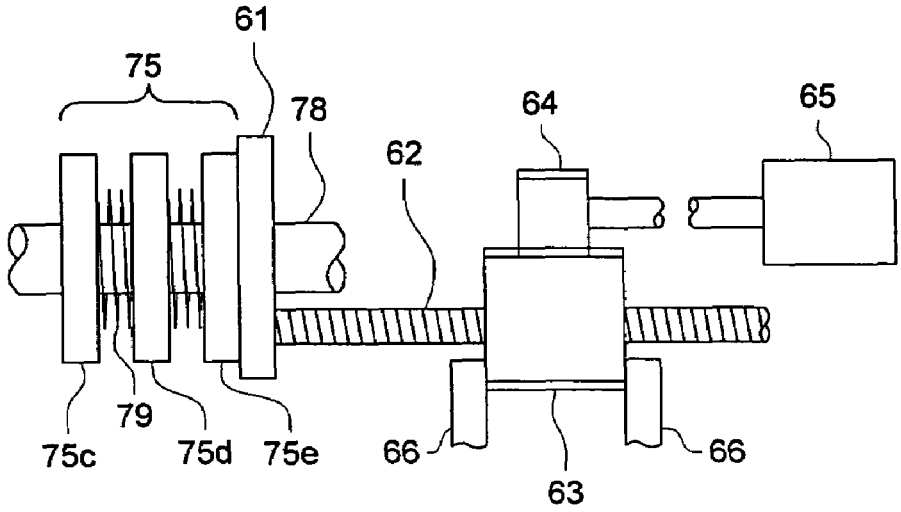
FIG. 5 shows the mechanism for moving multiple cores.

Next, an example of mechanism for changing the position of the core 75 by pressing the core 75 is described hereunder, using FIG. 5.

FIG. 5 shows the right-hand mechanism in the condition of FIG. 3(A). A pressing plate 61 is installed, capable of sliding freely on the shaft 78, on the right of the core 75*e*, and a male-threaded pressing bar 62 extrudes from the pressing plate 61. The pressing bar 62 is engaged with a female thread (not shown) provided inside the gear 63. The gear 63, of which movement in the axial direction is restricted by a restricting member 66, cannot move but simply rotates and is engaged with a gear 64. The gear 64 is connected with a motor 65 via a reduction gear (not shown).

With this mechanism, when the motor 65 is driven, the gear 64 is rotated via a reduction gear (not shown) and so the gear 63 is rotated. Since the movement of the gear 63 in the axial direction is restricted by the restricting member 64, it rotates without changing its position. As the female thread inside the gear is rotated, the pressing bar of which male thread is engaged with the female thread is moved leftward. Accordingly, the pressing plate 61 is moved leftward to press the core 75*e*. Although the core 75*d* is also pressed via the compression spring 79 when the core 75*e* is pressed, the cores 75*e*, 75*d* and 75*c* are positioned at equal distance because the core 75*c* is fastened on the shaft 78.

When the cores 75*a* to 75*e* are to be positioned in a shorter distance from the condition in FIG. 3(C), the same operation as above is applicable even in case of the condition in FIG. 3(B). However, if the cores 75*a* to 75*e* are to be positioned in a wider distance from the condition in FIG. 3(A) or to the condition in FIG. 3(B) or FIG. 3(C), the motor is rotated reversely so that the pressing bar 62 and pressing plate 61 are moved rightward. Thus, the cores 75*d* and 75*e* follow them are moved to the right by the compression spring 79.

In addition, a similar mechanism (not shown) shall be provided on the right so as to move the cores 75*a* and 75*b*.

A mechanism for moving the cores 75*a* to 75*e* is not limited to the above but any is acceptable, and various mechanisms including ones employing linkage, helicoid and cum are supposed to be applicable.

Figure 6:
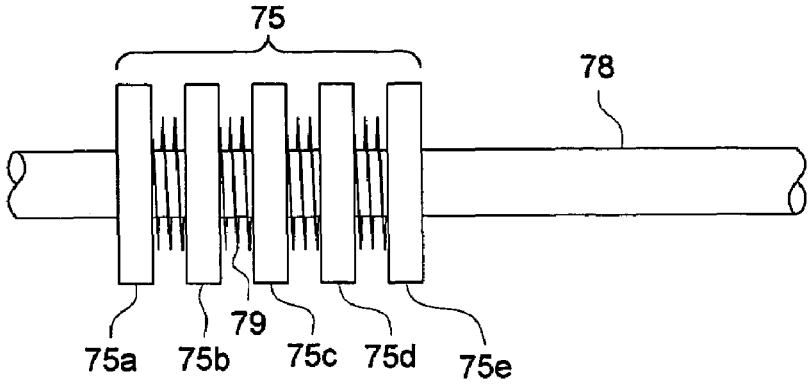
FIG. 6 shows the arrangement of multiple cores that move in accordance with the width of recording paper of which edge is regarded as the reference point of the movement.
Figure 6:
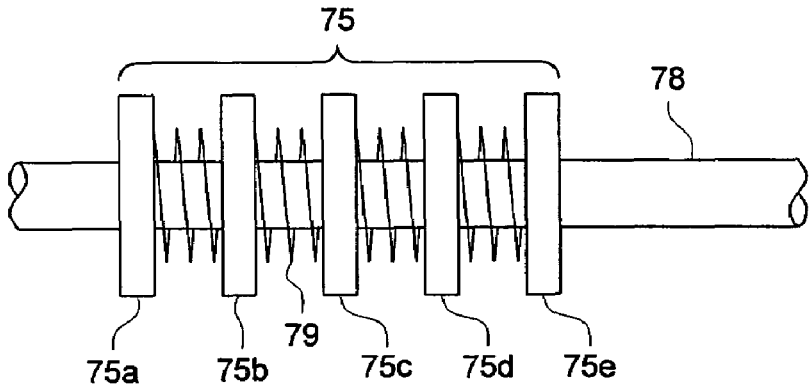
Figure 6:
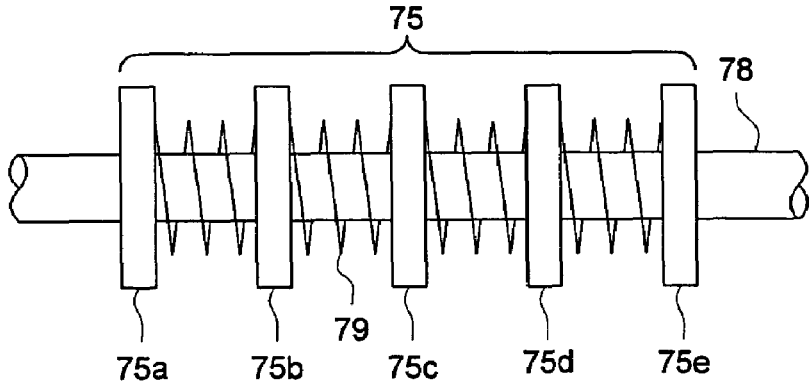

The arrangement of the cores 75*a* to 75*e* as described above using FIG. 3 and FIG. 4 is symmetrical about the center of the width of the recording paper P to be conveyed and accordingly the center position is constant for any recording paper P of different width. However, it is also allowable to employ such construction that one specified side of the width of the recording paper P is regarded the reference point and the recording paper P is conveyed accordingly. FIG. 6 shows the arrangement of the cores 75*a* to 75*e* in this construction.

In FIG. 6, FIG. 6(A) shows the arrangement of the cores 75*a* to 75*e* in case of fixing a small-size recording paper P, FIG. 6(B) shows in case of fixing a medium-size recording paper P, and FIG. 6(C) shows in case of fixing a large-size recording paper P. In FIG. 6, the core 75*a* on the left end is fastened on the shaft 78, and as the core 75*e* is pressed from the right, the center cores 75*d*, 75*c* and 75*b* are moved by the compression spring 79.

If the number of installed cores 75 is less and so the distance between adjacent cores 75 is wider in FIG. 3 to FIG. 6, the magnetic flux is focused on individual core 75*a* to 75*e*, resulting in uneven flux distribution, and consequently the heat distribution may become uneven. Increasing the number of cores 75 will solve the problem, but additional compression spring 79 is needed and so cost will increase. To solve this problem, description below, using FIG. 7, covers a core that seldom causes uneven magnetic flux distribution even if the number of installed cores 75 is less.

FIG. 7(A) shows the arrangement of the core 751 in case of fixing a small-size recording paper P, FIG. 7(B) shows in case of fixing a medium-size recording paper P, and FIG. 7(C) shows in case of fixing a large-size recording paper P. Each core 751*a* to 751*f* has the same shape, the insertion direction of the cores 751*a* to 751*c* into the shaft 78 is different from that of the cores 751*d* to 751*f*, and the cores 751*c* and 751*d* are fastened on the shaft 78. The outside of the core 751 is shaped into an approximate cone with its apex in the moving direction and a concave of the approximately same shape is provided on the bottom of the cone. With this construction, in FIG. 7(A) and FIG. 7(B), part of the outside of the core 751*b* (part of the apex side of the cone) is inserted in the concave of the core 751*a*, and the same applies to the core 751*b* and core 751*c*, core 751*d* and core 751*e*, and core 751*e* and core 751*f*. Even in a condition as shown in FIG. 7(C) where the distance between each core 751 becomes longer, no gap is caused between each core 751 and so no unevenness of flux distribution is caused, and consequently no unevenness of heat distribution is caused.

Figure 7:
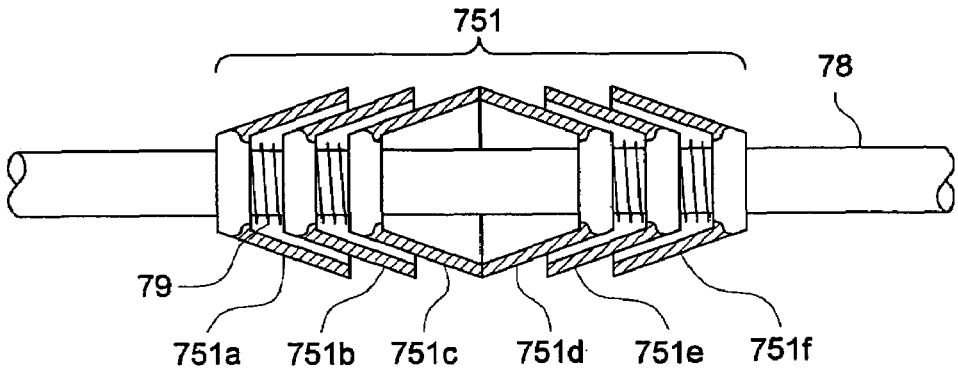
FIG. 7 shows the arrangement of multiple cores where uneven heat distribution is not caused even in case of small number of cores.
Figure 7:
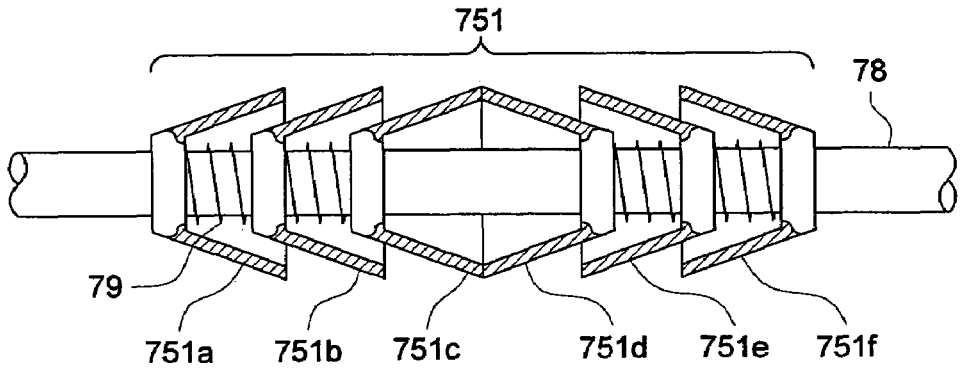
Figure 7:
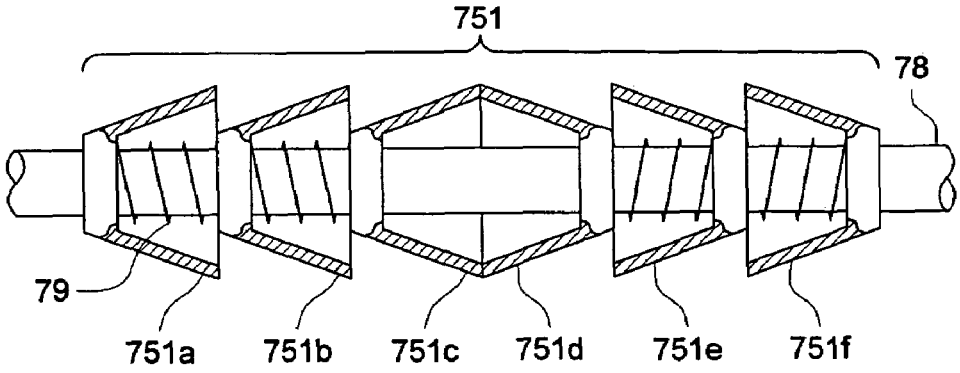

Accordingly, even if the number of installed cores 751 is less in FIG. 7, no unevenness of flux distribution is caused and consequently no unevenness of heat distribution is caused.

Although the core 75 and 751 described above is formed point-symmetrical about the shaft 78, point symmetry is not always necessary.

It is also allowable to provide a metallic layer made of nickel, copper, silver, gold, aluminum, titanium or alloy thereof on the fixing belt 73 and the metallic layer is made to generate heat by the exciting coil 74.

In addition, the fusing device may be of such construction that a fixing belt is passed between a heating roller, which contains a core inside and is equipped with an exciting coil near the outside surface, and a fixing roller, and only the fixing roller is pressed by a pressing roller via the fixing belt.

Furthermore, the fusing device may have such construction without using a fixing belt that a pressing roller is pressed onto a heating roller, which contains a core inside and is equipped with an exciting coil near the outside surface, and fixation is performed at a nip formed by the heating roller and pressing roller.

Figure 8:
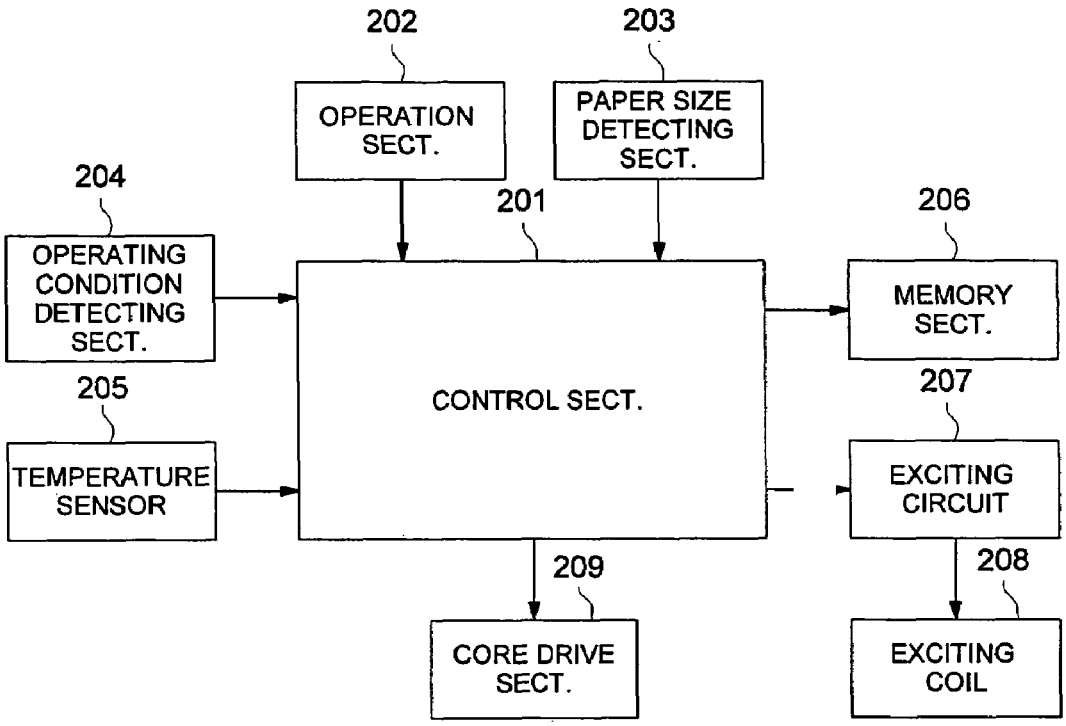
FIG. 8 is a block diagram for the control of the moving cores.

Next, a construction for controlling the cores 75 and 751 that move as shown in FIG. 3, FIG. 6 and FIG. 7 is described hereunder, using the block diagram in FIG. 8.

A control section 201 comprising CPU and others controls each component described hereunder.

An operation section 202 is installed on the image forming apparatus on FIG. 1 (not shown in FIG. 1) and applicable size (for example, A3, B4, A4, A4R, B5, or postcard) of the recording paper P is selected and set here by user operation.

A paper size detecting section 203 automatically detects the size of the fed recording paper P. For example, the size of original is sensed here and an applicable recording paper P is selected.

An operating condition detecting section 204 detects whether the image forming apparatus is operative, in operation, under warming-up, has completed a process of image forming under a preset condition, is idling, in a low-power mode, restoring from idling or low-power mode, or in a paper jam failure.

A temperature sensor 205 is equivalent to the temperature sensor TS shown in FIG. 2 and senses the temperature of the fixing belt 73.

A memory section 206 is a memory that stores the width of the recording paper P and condition of the image forming apparatus.

An exciting circuit 207 is applies high-frequency AC current to an exciting coil 208 that is equivalent to the exciting coil 74 in FIG. 2.

A core drive section 209 comprises the motor 65 shown in FIG. 5 that moves the cores 75 and 751.

In the above construction, the size of the recording paper P either set by user on the operation section 202 or detected by the paper size detecting section 203 automatically is inputted to the control section 201, and the size of the recording paper P is stored in the storage memory 206. Operating condition of the image forming apparatus sensed by the operating condition detecting section 204 is also inputted to the control section 201 and stored in the memory section 206. According to the paper size and operating condition of the image forming apparatus stored in the memory section 206, the control section 201 drives the core drive section 209 and moves the cores 75 and 751 in accordance with the size of the recording paper P to be fixed. Since the heat intensity varies depending upon the paper size, the control section 201 controls the exciting circuit 207 based on the temperature of the fixing belt 73 sensed by the temperature sensor 205, and changes the duration of applying high-frequency AC current to the exciting coil 208.

While the image forming apparatus is under warming-up, has completed a process of image forming under a preset condition, is idling, in a low-power mode, restoring from idling or low-power mode, or in a paper jam failure, the cores 75 and 751 are moved to the position corresponding to the maximum width of the recording paper P, for example as shown in FIG. 3(C).

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fusing device comprising:

an exciting coil that induces induction magnetic field by applying AC current;

a hollow heating member installed near the exciting coil; multiple magnetic members mounted along the heating member in the longitudinal direction; and a drive section that moves the multiple magnetic members in accordance with the width of transfer material to be fixed, wherein the outside of the magnetic member is shaped into an approximate cone with its apex in the moving direction and also a concave of the approximately same shape is provided on the bottom of the cone.

2. A fusing device according to claim 1, wherein the heating member is a rotating roller.

3. A fusing device according to claim 2, wherein given that the relative magnetic permeability of the heating member is $\mu 1$ and thickness is t1 and that the relative magnetic permeability of the magnetic member is $\mu 2$ and thickness is t2, preferably, $\mu 1 < \mu 2$ and $t1 < t2$ are met.

4. A fusing device according to claim 1, further equipped with a fixing roller; and a fixing belt that is passed between the heating member and the fixing roller and heated by heat from the heating member.

5. A fusing device according to claim 4, further equipped with a pressing roller that presses the fixing roller via the fixing belt.

6. A fusing device according to claim 1, wherein the multiple magnetic members are mounted inside the heating member.

7. A fusing device according to claim 1, wherein an elastic member is provided between each of the multiple magnetic members.

8. A fusing device comprising:

an exciting coil that induces induction magnetic field by applying AC current;

a hollow heating member installed near the exciting coil;

multiple magnetic members mounted along the heating member in the longitudinal direction; and a drive section that moves the multiple magnetic members in accordance with the width of transfer material to be fixed, wherein the drive section includes an elastic member provided between each of the multiple magnetic members.

9. A fusing device according to claim 8, wherein the elastic member includes spring.

10. A fusing device according to claim 8, wherein the drive includes a mechanism for compressing the elastic member.

11. A fusing device according to claim 8, wherein the multiple magnetic members are mounted inside the heating member.

* * * * *